US006279696B1

(12) United States Patent
Daugherty, Jr. et al.

(10) Patent No.: US 6,279,696 B1
(45) Date of Patent: Aug. 28, 2001

(54) SUSPENSION SYSTEM FOR A TRUCK MOUNTED BRAKE ASSEMBLY

(75) Inventors: David W. Daugherty, Jr., Plainfield, IL (US); Michael E. Ring, Crown Point, IN (US); Michael J. Moriarity, Lansing, IL (US); David C. Brabb, Chicago, IL (US); Scott Natschke, Kankakee, IL (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 09/317,514

(22) Filed: May 24, 1999

(51) Int. Cl.[7] ..... F16D 65/14
(52) U.S. Cl. ..... 188/215; 188/219.1; 188/209
(58) Field of Search ..... 188/214, 215, 188/209, 219.6, 220.1, 220.6, 222.1, 219.1

(56) References Cited

U.S. PATENT DOCUMENTS 879,606 * 2/1908 Adams ..... 188/209
1,415,730 * 5/1922 Taylor ..... 188/209
1,939,106 * 12/1933 Clouser ..... 188/209
4,211,311 * 7/1980 McMullen ..... 188/209
4,553,642 * 11/1985 Yates ..... 188/56
4,795,007 * 1/1989 Murphy et al. ..... 188/207
4,895,228 * 1/1990 Washbourn et al. ..... 188/202
5,069,312 * 12/1991 Kanjo et al. ..... 188/52
5,400,874 * 3/1995 Gayfer et al. ..... 188/52
5,901,819 * 5/1999 Engle ..... 188/219.1

* cited by examiner

*Primary Examiner*—Robert J. Oberleitner
*Assistant Examiner*—Devon Kramer
(74) *Attorney, Agent, or Firm*—James Ray & Associates

(57) ABSTRACT

A suspension system for suspending a truck mounted brake assembly within a railway vehicle truck arrangement is provided. The suspension system comprises suspension members, each of the suspension members being pivotally connected at a first end with a predetermined portion of the railway vehicle truck arrangement and pivotally connected at a second end with a predetermined portion of the truck mounted brake assembly for suspending a pair of brake beams in the railway vehicle truck arrangement. At least one maintaining member is provided having at least a portion thereof connected with the truck mounted brake assembly for maintaining each of the brake beams in a predetermined plane during application and release of the railway vehicle brake assembly.

33 Claims, 9 Drawing Sheets

FIG. 11
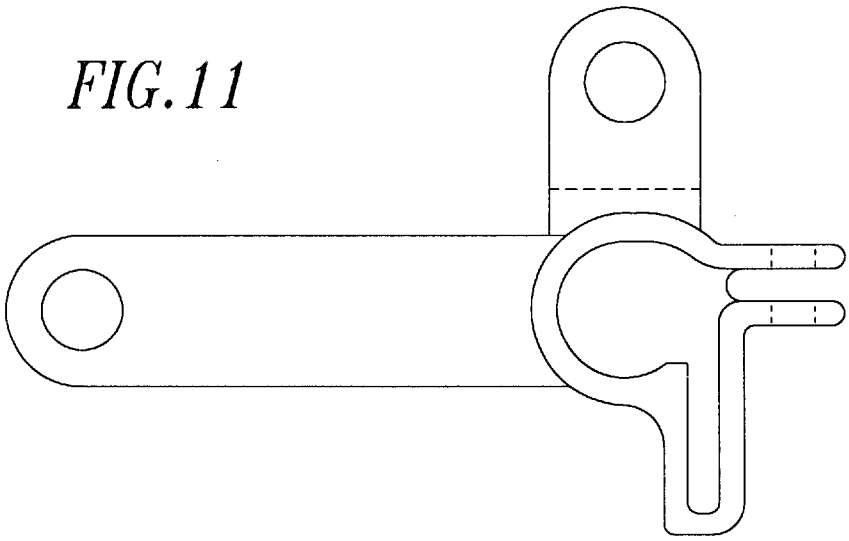
FIG. 12
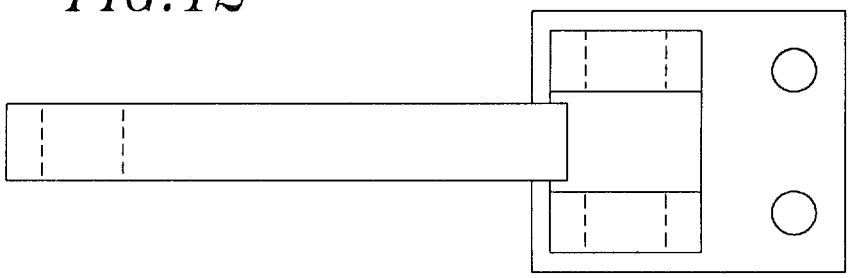
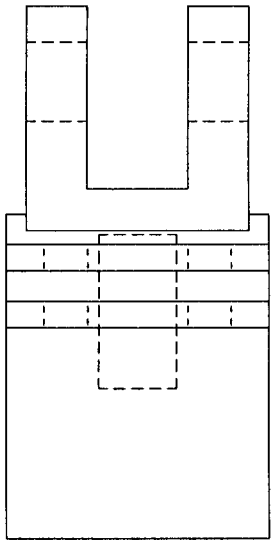
FIG. 13

SUSPENSION SYSTEM FOR A TRUCK MOUNTED BRAKE ASSEMBLY

FIELD OF THE INVENTION

The present invention relates, in general, to a braking system for a railway vehicle and, more particularly, to a suspension system for suspending a bogie system or truck mounted brake assembly within a railway vehicle truck arrangement.

BACKGROUND OF THE INVENTION

Truck mounted brake assemblies are well known in the railway industry. These brake assemblies have several desirable qualities which makes them very popular with railway vehicle manufacturers. One type of a truck mounted brake assembly is one which is commonly referred to in the railway industry as a WABCOPAC® braking system (WABCOPAC® is a registered trademark to Westinghouse Airbrake Company, the assignee of the present invention) This truck mounted braking system typically comprises a pair of brake beams, having brake heads secured at the ends thereof, separated by a pair of brake cylinders. This system permits direct application of brake cylinder force to the brake shoes.

Another type of known truck mounted braking system is one which is commonly referred to as a TMX® truck mounted braking system (TMX® is a registered trademark to Westinghouse Airbrake Company, the assignee of the present invention). The TMX® truck mounted braking system has several desirable qualities which also makes this system popular with railway vehicle manufacturers. The most significant of these qualities are that these brake assemblies are formed of highly durable, lightweight material and utilize a single brake cylinder providing a significant weight reduction per carset. Another quality of these brake assemblies is that they are easy to install and adjust, require no special bolsters or connections for this installation, readily fit all standard trucks with combination bolsters and allow for simplified replacement of the brake heads. Another significant advantage of the TMX® truck mounted brake assembly is that the arrangement of the components within the brake assembly, including the use of a double-jaw slack adjuster, allows for a more even brake shoe wear than previously used types of braking systems.

Various other types of truck mounted braking systems are well known in the railway industry. The common characteristic of these currently used truck mounted braking systems in the U.S. railway industry is that the truck side frames are fixed to the wheel and axle and consequently, the truck mounted braking system is secured to the truck side frame. This type of mounting of the braking system subjects the braking system to a significant amount of shock as the railway vehicle moves along a route. Additionally, due to this type of mounting, occasionally, full contact is not made between the brake shoes and the wheels as the car moves up and down.

This differs from the European railway industry wherein the bolster and side frame move with the body. Thus, in the European market, presently used braking systems are suspended within the truck arrangement so that the braking system becomes part of the sprung system of the vehicle, giving the braking system more cushion and preventing shock onto the system.

A significant drawback to the systems currently in use in the European market is that these braking systems require the use of an individual brake unit at each wheel, significantly increasing the cost of the braking system and the cost of maintaining each of these individual units. Another disadvantage is that the use of an individual braking unit at each wheel significantly increases the weight of the carsets, as well as, the energy required to power the railway vehicle.

SUMMARY OF THE INVENTION

A suspension system for suspending a truck mounted brake assembly within a railway vehicle truck arrangement. The railway vehicle truck arrangement includes a pair of truck side frames, a wheel and axle set at each end of the pair of truck side frames and a truck bolster member. The truck mounted brake assembly includes a pair of brake beams, a strut member securable with each of the brake beams and a brake head attachable to each end of each of the brake beams. Each of the brake heads which carry a brake shoe thereon are positioned for engagement of a respective one of the brake shoes with a respective railway vehicle wheel during a brake application.

The suspension system comprises a first means pivotally connected at a first end with a predetermined portion of the railway vehicle truck arrangement and pivotally connected at a second end with a predetermined portion of the truck mounted brake assembly for suspending the pair of brake beams in the railway vehicle truck arrangement. A second means is provided having at least a portion thereof connected with the truck mounted brake assembly for maintaining each of the brake beams in a predetermined plane during application and release of the railway vehicle brake assembly.

OBJECTS OF THE INVENTION

It is an object of the present invention to provide a suspension system for suspending a truck mounted brake assembly within a railway vehicle truck arrangement.

It is a further object of the invention to provide a suspension system for suspending a truck mounted brake assembly within a railway vehicle truck arrangement which provides more cushion and reduces the amount of shock endured by the braking system.

It is yet a further object of the invention to provide a suspension system for suspending a truck mounted brake assembly within a railway vehicle truck arrangement so as to achieve full contact of the brake shoes against the wheel as the car moves up and down, allowing for an even wear of the brake shoes and better energy efficiency.

It is another object of the invention to provide a suspension system for suspending a truck mounted brake assembly within a railway vehicle truck arrangement so that this truck mounted brake assembly may be utilized in a broader range of braking systems.

It is yet a further object of the invention to provide a suspension system for suspending a truck mounted brake assembly within a railway vehicle which provides a braking system having greater energy efficiency, requires less maintenance, and is less expensive.

Although a number of objects and advantages of the present invention have been described in some detail above, various additional objects and advantages of the suspension system for suspending a truck mounted braking system within a railway vehicle truck arrangement will become more readily apparent to those persons who are skilled in the art from the following more detailed description of the invention, particularly, when such detailed description of the invention is taken in conjunction with both the attached drawing figures and with the appended claims.

BRIEF DESCRIPTION OF THE DRAWINGS

FIG. 11 is a side view of an example of the link member which may be used in the suspension system.

FIG. 12 is a front view of the link member illustrated in FIG. 11.

FIG. 13 is an end view of the link member illustrated in FIG. 11.

DETAILED DESCRIPTION OF THE INVENTION

Figure 1:
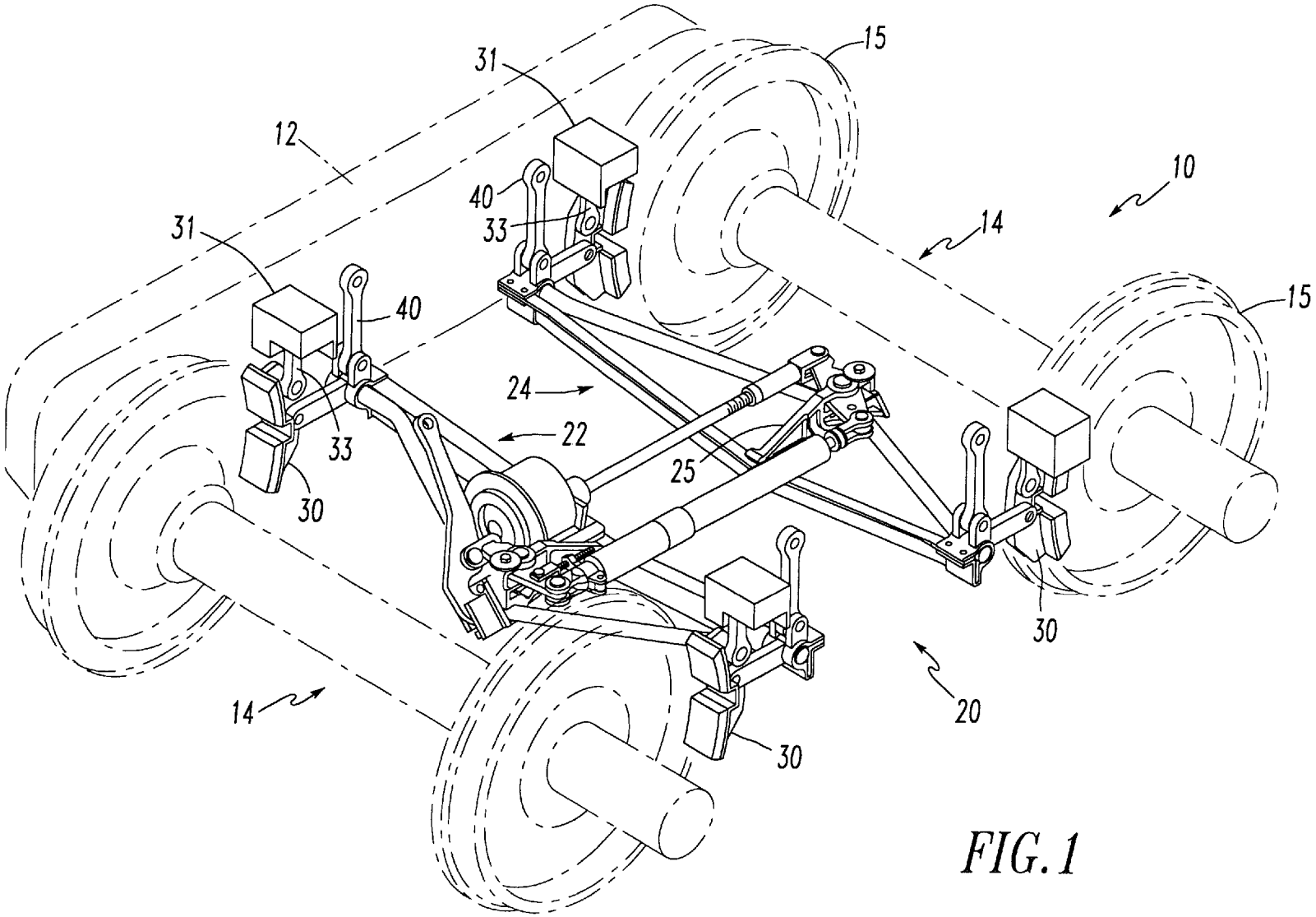
FIG. 1 is a perspective view illustrating the suspension system according to a first embodiment of the invention wherein the suspension system includes a series of link members pivotally connected with the side frames of the railway vehicle.

Prior to proceeding with the more detailed description of the invention, it should be noted that for the sake of clarity, identical components with have identical functions have been identified with identical reference numerals throughout the several views illustrated in the attached drawing Figures.

Figure 6:
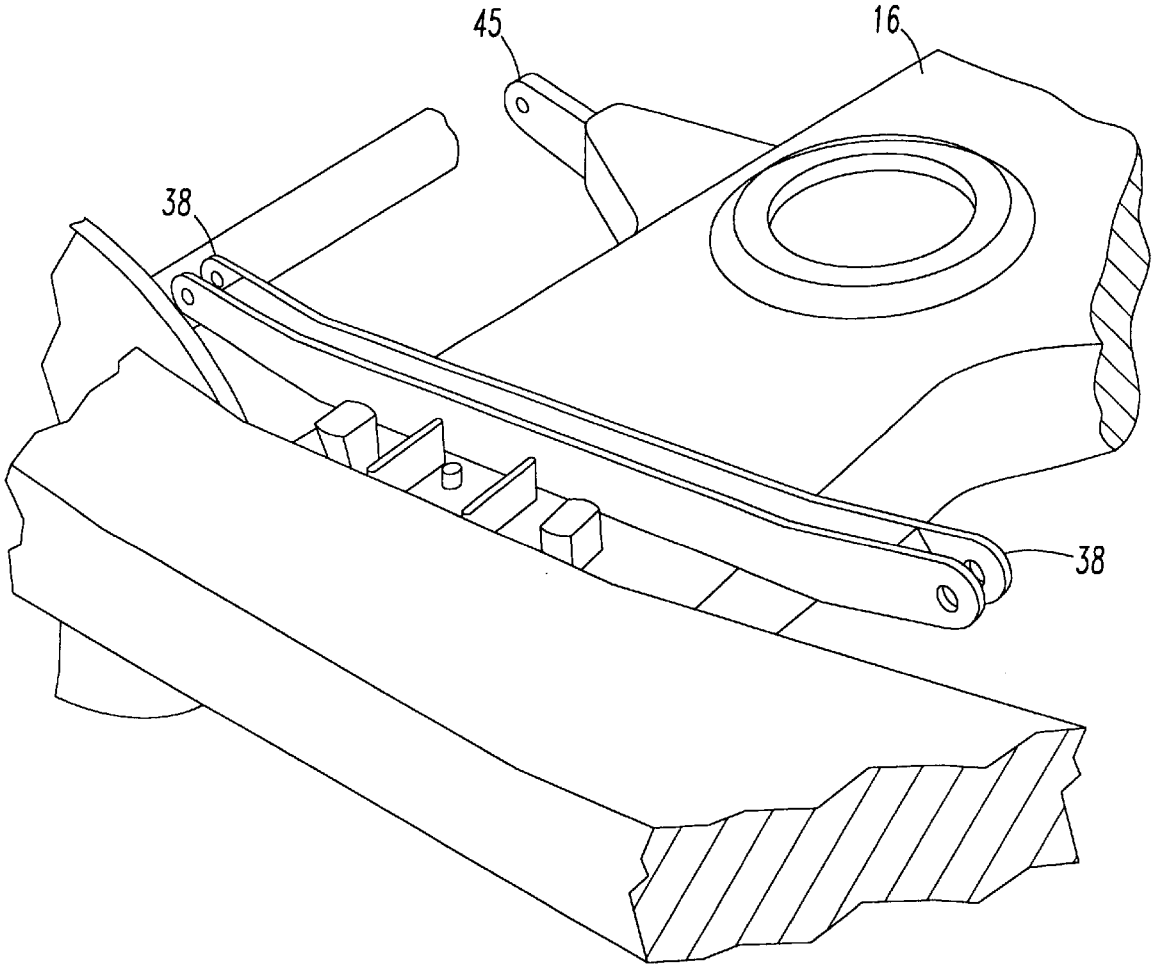
FIG. 6 is a truck arrangement including extension members on the truck bolster member enabling the use of the truck bolster member as an alternative location for pivotal attachment of the series of link members.
Figure 7:
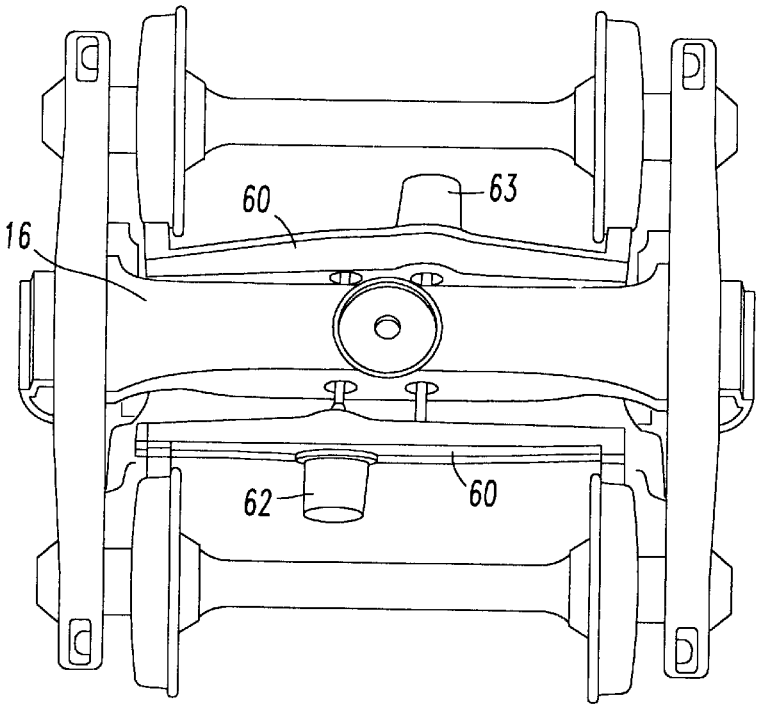
FIG. 7 is a top perspective view illustrating a type of truck mounted braking system which may be suspended within a railway vehicle truck arrangement.

Referring now to the Figures there is shown a presently preferred embodiment of a railway vehicle truck arrangement, generally designated 10, for a railway car (not shown). This railway vehicle truck arrangement comprises a pair of truck side frames, one of which is shown in the Figures as 12, a wheel and axle set, generally designated as 14, at each end of the truck side frames 12 and a truck bolster member 16 (FIGS. 6 and 7). Suspended within the railway vehicle truck arrangement 10 is an example of a truck mounted brake assembly, generally designated 20. This particular type of truck mounted brake assembly 20 includes a pair of brake beams, generally designated 22 and 24, a strut member 25 securable with each of the brake beams 22, 24 and a brake head 30 attachable to each end of each of the brake beams 22, 24. Each of the brake heads 30 carry a brake shoe 32 thereon and are positioned for engagement of a respective one of the brake shoes 32 with a respective railway vehicle wheel 15 during a brake application.

A suspension system is provided for suspending the truck mounted brake assembly 20 within the railway vehicle truck arrangement 10. This suspension system generally comprises a first means pivotally connected at a first end with a predetermined portion of the railway vehicle truck arrangement 10 and pivotally connected at a second end with a predetermined portion of the truck mounted brake assembly 20 for suspending the pair of brake beams 22, 24 in the railway vehicle truck arrangement 10. A second means is provided having at least a portion thereof connected with either each one of the pair of brake beams 22, 24 or each one of the strut members 25. This second means maintains each of the brake beams 22, 24 in a predetermined plane during application and release of the railway vehicle brake assembly 20.

Figure 2:
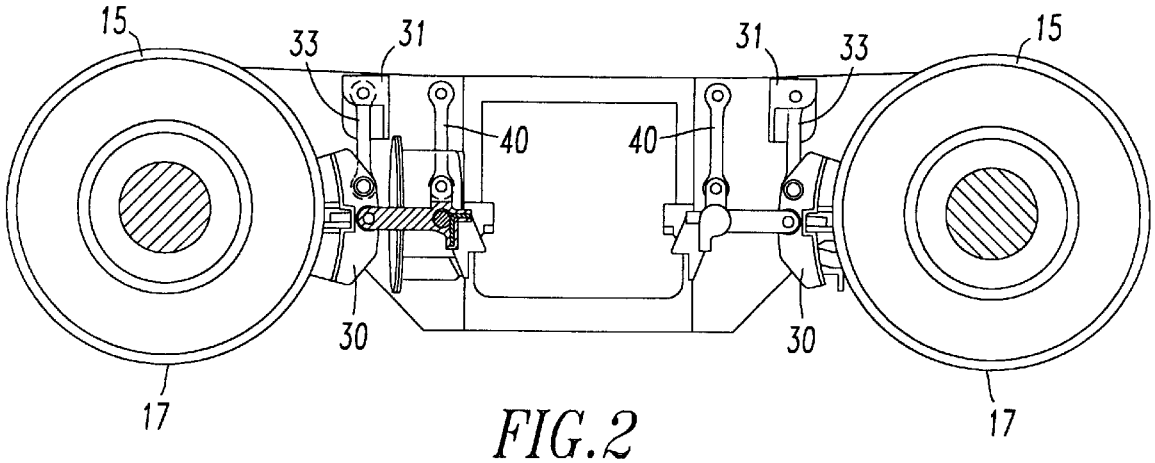
FIG. 2 is a schematic side elevation view illustrating the suspension system shown in FIG. 1.
Figure 3:
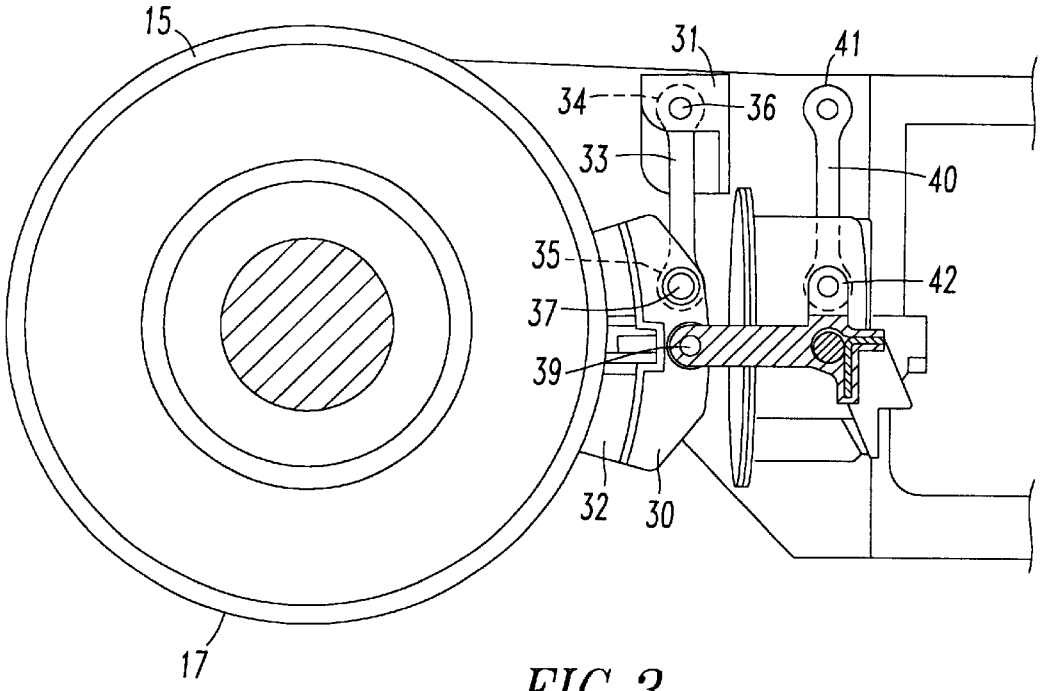
FIG. 3 is a partial side elevation view of the brake head/railway wheel arrangement of the suspension system illustrated in FIG. 1.

Referring now to FIGS. 1–3, there is shown a first embodiment of a suspension system for suspending the truck mounted brake assembly 20. In this embodiment, the first means for suspending the brake beams 22, 24 within the truck arrangement 10 includes at least two suspension link members 33 having a first end 34 and a second end 35. The first end 34 of each of the suspension link members 32 are pivotally attachable with each of the truck side frames 12 and the second end 35 of each of the suspension link members 33 are pivotally attachable with a respective one of the brake heads 30. An extension member 31 may be provided on the truck side frames 12 to enable attachment of the suspension link members 33 thereto. Alternatively, the first end 34 of each of the suspension link members 32 may be pivotally attachable with the truck bolster member 16 via extension members 38, as shown in FIG. 6, which are placed at each end of the truck bolster member 16. These extension members may be any shape as long as they are sufficiently long enough so as to enable the link member to hang therefrom substantially in alignment with the location upon which attachment of the link member is desired.

The pivotal attachment of the first end 34 of the suspension link members 33 with the railway vehicle truck arrangement forms a first pivot point 36 and the pivotal attachment of the second end 35 of the suspension link members 33 with the brake heads 30 form a second pivot point 37. These brake heads 30 are attached to the brake beams 22, 24 via a third pivot point 39. These pivotal attachments allow the brake heads 30 to pivot about the second 37 and third 39 pivot points such that the brake heads 30 carrying the brake shoes 32 are capable of matching a radius 17 of the railway vehicle wheel 15 during a brake application.

The second means for maintaining each of the brake beams 22, 24 in a predetermined plane during application and release of the railway vehicle brake assembly 20 includes at least two maintaining link members 40 having a first end 41 and a second end 42. The first end 41 of each of the maintaining link members is pivotally attachable with either the truck side frames 12 or alternatively, the truck bolster member 16 via extension members 38, as illustrated in FIG. 6. An extension member, not shown, can be provided for enabling attachment of link members 40 to the side frames 12. The second end 42 of each of the maintaining link members 40 are pivotally attachable with a respective one of the pair of brake beams 22, 24.

The above described embodiment illustrates a suspension system which utilizes a total of eight link members per braking system. A second embodiment would reduce this number of link members to six per braking system. This second embodiment would replace the two maintaining link members 40 which are secured to each of the brake beams 22 and 24 with a single maintaining link member per brake beam. This single link member per brake beam would include a first end and a second end wherein the first end of each of the maintaining link members is pivotally attachable with the truck bolster member 16 and the second end of each of the maintaining link members is pivotally attachable with a respective one of the strut members 25. This pivotal attachment of the maintaining link members between the truck bolster 16 and the strut members 25 is achieved via an extension member 45, as illustrated in FIG. 6. Thus, this embodiment would reduce the number of link members for suspending the brake system within the truck arrangement from eight to six link members per braking system.

An alternative to the second embodiment would be to eliminate the suspension link members 33 attached to the brake heads 30 and replace these link members 33 with a single link member mounted to each of the strut members 25. In this alternative embodiment, the link members 40 attached between the side frames 12 or bolster 16 and the brake beams 22, 24 would perform the function of suspending the braking system. The single link members would include a first end and a second end wherein the first end of each of the link members is pivotally attachable with the truck bolster member 16 and the second end of each of the single link members is pivotally attachable with a respective one of the strut members 25. This pivotal attachment of the single link members between the truck bolster 16 and the strut members 25 is achieved via an extension member 45, as illustrated in FIG. 6. Thus, this embodiment would reduce the number of link members for suspending the brake system within the truck arrangement from four to three link members per brake beam.

Figure 4:
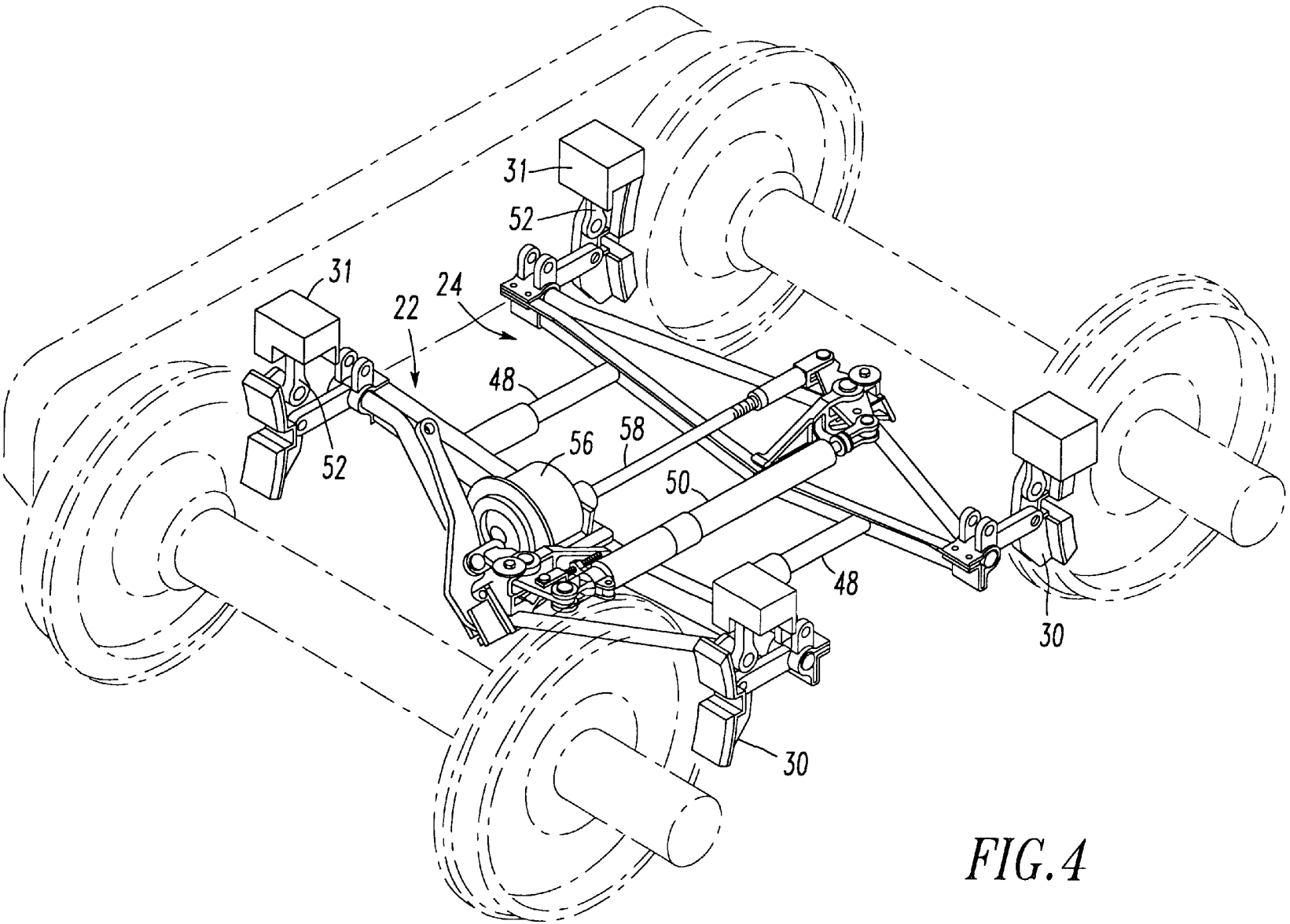
FIG. 4 is a perspective view illustrating the suspension system according to an alternative embodiment of the invention wherein the suspension system includes a series of link members pivotally connected with the truck arrangement and a telescoping member disposed between and attached to the pair of brake beams.
Figure 5:
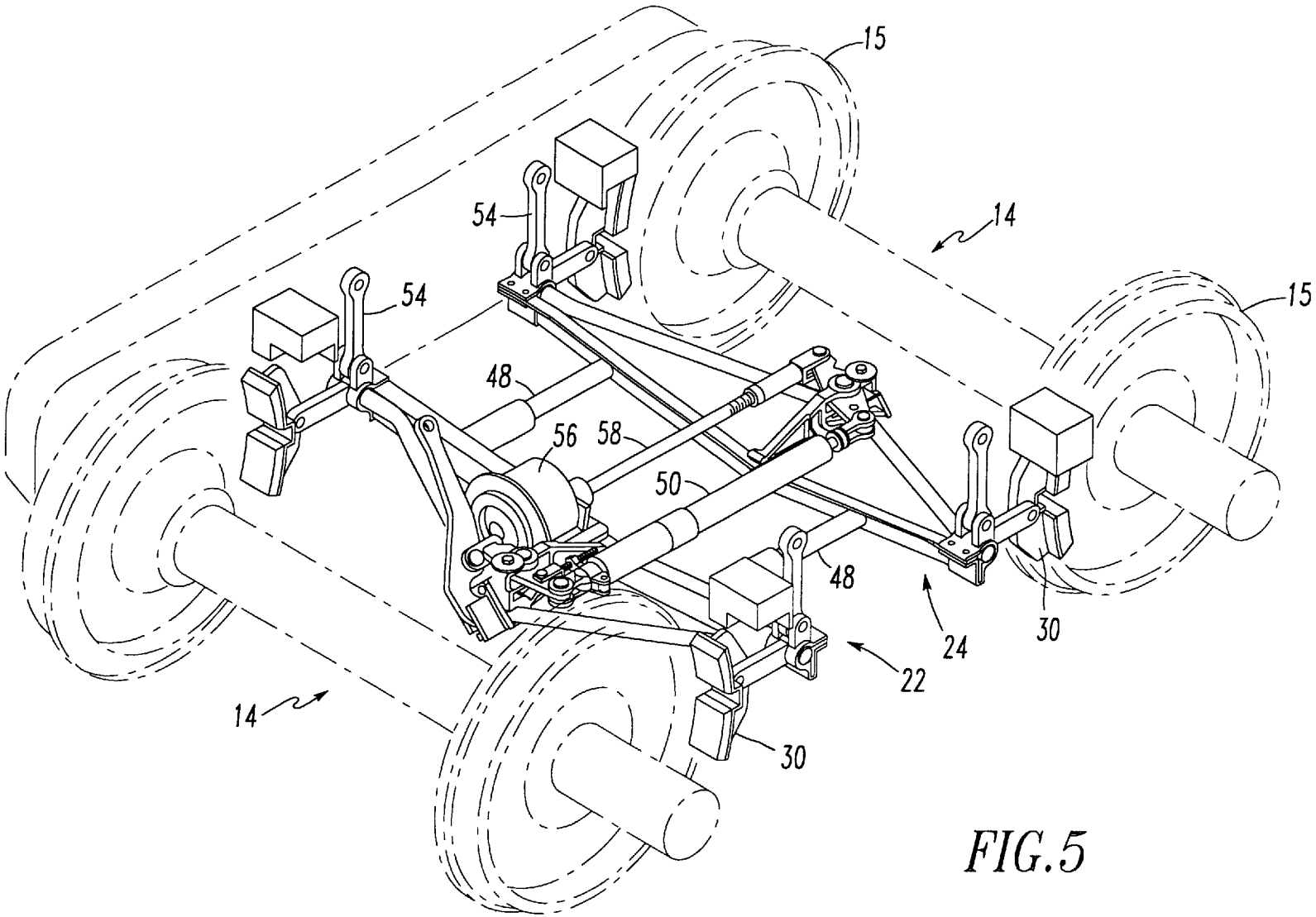
FIG. 5 is a perspective view of the suspension system similar to that illustrated in FIG. 4 wherein the series of link members are connected with the truck arrangement in an alternative location.

A third embodiment of the invention would further reduce the number of hanging links to four per braking system. In this embodiment, as illustrated in FIGS. 4 and 5, a telescoping means 48 is disposed between and connected to each one of the pair of brake beams 22, 24. This telescoping means would be capable of maintaining the brake beams 22 and 24 in a predetermined plane during application and release of the railway vehicle brake assembly. The telescoping means also would be capable of shortening and lengthening as needed during application and release of the brakes and as the distance between the brake beams increases or decreases via a slack adjuster 50 during wear and/or replacement of the brake shoes 32.

In FIG. 4, this telescoping means 48 works in combination with suspension link members 52 which are pivotally attached between the truck side frames 12 and the brake heads 30. An extension member 31 may be provided for attaching the suspension link members 52 from the truck side frames 12. Note that these suspension link members 52 may be alternatively attached with the truck bolster 16 via extension members 38 as illustrated in FIG. 6.

In FIG. 5, the telescoping means works in combination with suspension link members 54 which are pivotally attached between the truck side frames 12 and the brake beams 22, 24. Once again, note that an extension member on the truck side frames 12 may be provided for attaching the link members 54 therefrom. Also, note that these suspension link members 54 may be alternatively attached with the truck bolster 16 via extension members 38 as illustrated in FIG. 6.

A fourth embodiment of the invention would eliminate the telescoping means, as shown in FIGS. 4 and 5, and to allow one or both of the slack adjuster 50 and the brake cylinder 56/return push rod assembly 58 to function as the second means or the means for maintaining the brake beams 22, 24 in a predetermined plane during application and release of the railway vehicle brake assembly. The link members 52 or 54, whether secured to the truck side frames 12 or the truck bolster 16 and pivotally attached with the brake heads 30 or the brake beams 22, 24, would still be provided so as to suspend the braking system 20 within the truck arrangement 10.

An advantage of the hanging link members of the suspension system of the invention is that these link members enable the suspension system to be mounted in a predetermined position such that as brake shoe wear occurs, the brake assembly is capable of compensating for this brake shoe wear so as to substantially maintain a predetermined distance between each of such brake shoes and such railway vehicle wheels.

Heretofore, the Figures have illustrated the suspension system of the present invention in relation to its use for suspending a TMX® truck mounted braking system within a railway vehicle truck arrangement, however, the suspension system of the present invention is not limited to this type of braking system and is applicable to other types of truck mounted braking systems. FIG. 7 shows a different type of truck mounted braking system which may be suspended within a railway vehicle truck arrangement according to the present invention. This braking system includes a pair of cast brake beams 60 having a brake head mounted at each end thereof. A pair of brake cylinders 62, 63 are provided between the brake beams. These brake cylinders 62, 63 extend substantially perpendicular with respect to a longitudinal centerline of the truck bolster 16. This type of braking system may be suspended within the railway vehicle arrangement according to the above described embodiments wherein a series of links along with the pair of brake cylinder/push rods are provided for suspending and maintaining the braking system within the railway vehicle truck arrangement. Of course, the other embodiments comprising a series of links or a series of links along with a telescoping means positioned between the brake beams may be used for suspending this braking system within the truck arrangement. Alternatively, extension members 38 and/or 45, as shown in FIG. 6 may be provided on the truck bolster so that the various link members for suspending and maintaining the braking system in position may be pivotally connected thereto. In the six link embodiment, the link member attached to the truck bolster 16 via extension member 45 would be secured with a center portion of each of the brake beams 60.

Figure 8:
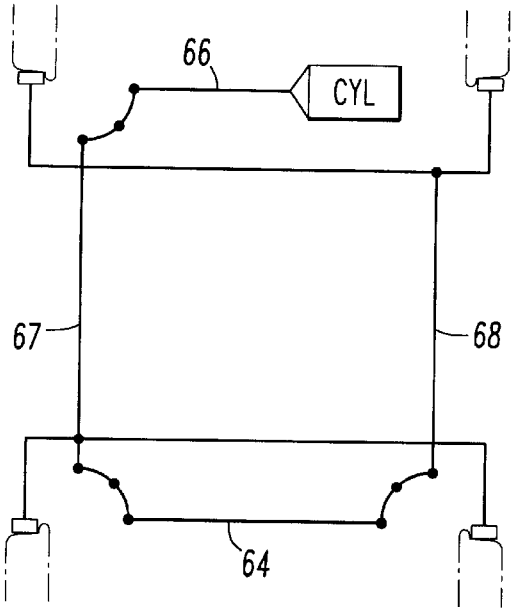
FIG. 8 is a schematic view illustrating another type of truck mounted braking system which may be suspended within a railway vehicle truck arrangement.

FIG. 8 shows yet another type of truck mounted braking system which may be suspended within a railway vehicle truck arrangement utilizing the suspension system of the present invention. In this type of truck mounted braking system, the second means includes at least one of a slack adjuster (or solid rod) 64 and a brake cylinder/push rod system 66 extending substantially parallel with respect to a longitudinal centerline of the truck bolster 16 and secured to the truck mounted brake assembly. This braking system can also include solid rods or slack adjusters 67 and 68 which extend in a perpendicular direction with respect to the longitudinal centerline of the truck bolster (not shown). The above described embodiments of the invention may be used to suspend this braking system within the truck arrangement.

Figure 9:
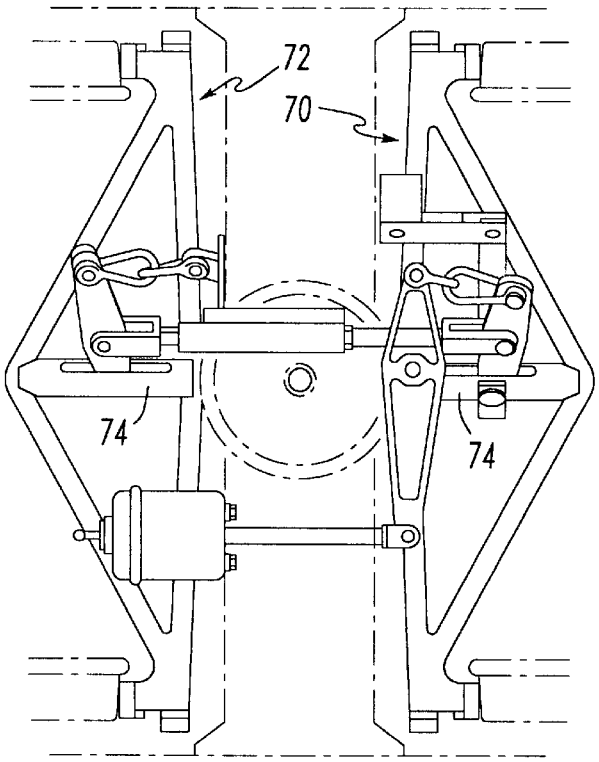
FIG. 9 is a top view illustrating yet another type of truck mounted braking system which may be suspended within a railway vehicle truck arrangement.

FIG. 9 is another example of a truck mounted braking system which may be suspended within a truck arrangement utilizing the suspension system of the present invention. This system is similar to the TMX® braking system in that it includes truss type brake beams 70, 72 and strut members 74. Any of the above described embodiments of the invention may be used to suspend this braking system within the truck arrangement.

Figure 10:
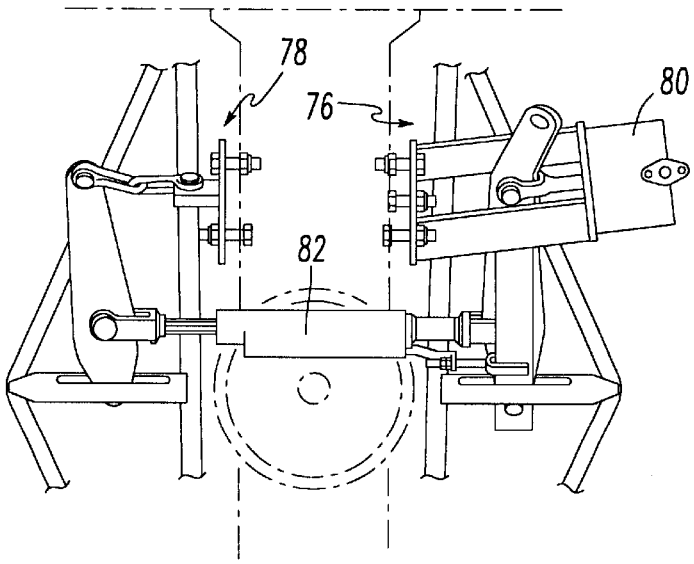
FIG. 10 is a partial to view illustrating yet another type of truck mounted braking system which may be suspended within a railway vehicle truck arrangement.
Figure 14:
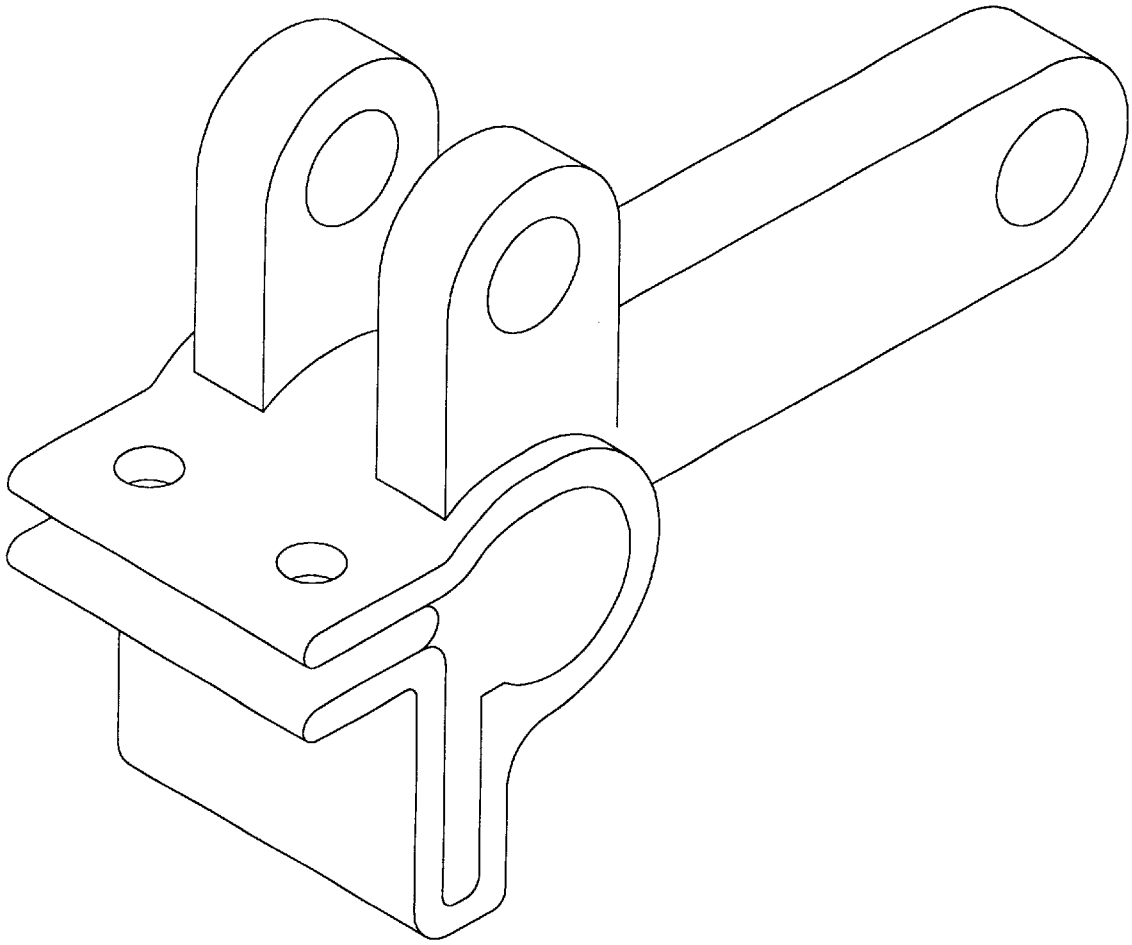
FIG. 14 is a perspective view of the link member illustrated in FIG. 11.

FIG. 10 is still another example of a truck mounted braking system which may be suspended with a truck arrangement utilizing the suspension system of the present invention. This system also includes truss type brake beams 76, 78. In this system, a brake cylinder 80 is secured from the truck bolster (not shown) and the second means includes a slack adjuster 82 extending substantially perpendicular with respect to a longitudinal centerline of the truck bolster and secured to the pair of brake beams 76, 78. Any of the above described embodiments of the invention may be used to suspend this braking system within the truck arrangement.

FIGS. 11–14 show a side view, top view, end view, and perspective view, respectively of the preferred link member for use in the suspension system of the invention.

Thus the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. A suspension system for suspending a truck mounted brake assembly within a railway vehicle truck arrangement, such railway vehicle truck arrangement including a pair of truck side frames, a wheel and axle set at each end of such pair of truck side frames and a truck bolster member, such truck mounted brake assembly including a pair of brake beams and a brake head attachable to each end of each of such brake beams, each of such brake heads carrying a brake shoe thereon, each of such brake heads being positioned for engagement of a respective one of such brake shoes with each of such wheels during a brake application, said suspension system comprising:

(a) a first means pivotally connected at a first end thereof with a predetermined portion of such railway vehicle truck arrangement and pivotally connected at a second end thereof to a predetermined portion of such truck mounted brake assembly for suspending such pair of brake beams in such railway vehicle truck arrangement; and (b) a second means having at least a portion thereof connected with such truck mounted brake assembly for maintaining each of such brake beams in a predetermined plane during application and release of such railway vehicle brake assembly.

2. A suspension system for suspending a truck mounted brake assembly within a railway vehicle truck arrangement, as recited in claim 1, wherein said first means includes at least two suspension link members having a first end and a second end, said first end of each of said suspension link members being pivotally attachable with one of each of such truck side frames and such truck bolster member and said second end of each of said suspension link members being pivotally attachable with a respective one of such brake heads.

3. A suspension system for suspending a truck mounted brake assembly within a railway vehicle truck arrangement, as recited in claim 2, wherein said second means includes at least two maintaining link members having a first end and a second end, said first end of each of said maintaining link members being pivotally attachable with one of each of such truck side frames and such truck bolster member and said second end of each of said maintaining link members being pivotally attachable with a respective one of such pair of brake beams.

4. A suspension system for suspending a truck mounted brake assembly within a railway vehicle truck arrangement, as recited in claim 2, wherein such truck mounted brake assembly includes a strut member securable with each of such brake beams and said second means includes at least two maintaining link members having a first end and a second end, said first end of each of said maintaining link members being pivotally attachable with such truck bolster member and said second end of each of said maintaining link members being pivotally attachable with a respective one of such strut members.

5. A suspension system for suspending a truck mounted brake assembly within a railway vehicle truck arrangement, as recited in claim 2, wherein said second means includes a telescoping means disposed between and connected to each one of such pair of brake beams.

6. A suspension system for suspending a truck mounted brake assembly within a railway vehicle truck arrangement, as recited in claim 2, wherein said second means includes at least one of a slack adjuster and a brake cylinder extending substantially perpendicular with respect to a longitudinal centerline of such truck bolster and secured to such truck mounted brake assembly.

7. A suspension system for suspending a truck mounted brake assembly within a railway vehicle truck arrangement, as recited in claim 2, wherein said second means includes at least one of a slack adjuster and a brake cylinder extending substantially parallel with respect to a longitudinal centerline of such truck bolster and secured to such truck mounted brake assembly.

8. A suspension system for suspending a truck mounted brake assembly within a railway vehicle truck arrangement, as recited in claim 2, wherein said second means includes a pair of brake cylinders extending substantially perpendicular with respect to a longitudinal centerline of such truck bolster and secured to such pair of brake beams.

9. A suspension system for suspending a truck mounted brake assembly within a railway vehicle truck arrangement, as recited in claim 2, wherein such truck mounted brake assembly includes a brake cylinder secured from such truck bolster and said second means includes a slack adjuster extending substantially perpendicular with respect to a longitudinal centerline of such truck bolster and secured to such pair of brake beams.

10. A suspension system for suspending a truck mounted brake assembly within a railway vehicle truck arrangement, as recited in claim 1, wherein said first means includes at least two suspension link members having a first end and a second end, said first end of each of said suspension link members being pivotally attachable with one of each of such truck side frames and such truck bolster member and said second end of each of said suspending link members being pivotally attachable with a respective one of such pair of brake beams.

11. A suspension system for suspending a truck mounted brake assembly within a railway vehicle truck arrangement, as recited in claim 10, wherein such truck mounted brake assembly includes a strut member securable with each of such brake beams and said second means includes at least two maintaining link members having a first end and a second end, said first end of each of said maintaining link members being pivotally attachable with such truck bolster member and said second end of each of said maintaining link members being pivotally attachable with a respective one of such strut members.

12. A suspension system for suspending a truck mounted brake assembly within a railway vehicle truck arrangement, as recited in claim 10, wherein said second means includes a telescoping means disposed between and connected to each one of such pair of brake beams.

13. A suspension system for suspending a truck mounted brake assembly within a railway vehicle truck arrangement, as recited in claim 10, wherein said second means includes at least one of a slack adjuster and a brake cylinder extending substantially perpendicular with respect to a longitudinal centerline of such truck bolster and secured to such truck mounted brake assembly.

14. A suspension system for suspending a truck mounted brake assembly within a railway vehicle truck arrangement, as recited in claim 10, wherein said second means includes at least one of a slack adjuster and a brake cylinder extending substantially parallel with respect to a longitudinal centerline of such truck bolster and secured to such truck mounted brake assembly.

15. A suspension system for suspending a truck mounted brake assembly within a railway vehicle truck arrangement, as recited in claim 10, wherein said second means includes a pair of brake cylinders extending substantially perpendicular with respect to a longitudinal centerline of such truck bolster and secured to such pair of brake beams.

16. A suspension system for suspending a truck mounted brake assembly within a railway vehicle truck arrangement, as recited in claim 10, wherein such truck mounted brake assembly includes a brake cylinder secured from such truck bolster and said second means includes a slack adjuster extending substantially perpendicular with respect to a longitudinal centerline of such truck bolster and secured to such pair of brake beams.

17. A suspension system for suspending a truck mounted brake assembly within a railway vehicle truck arrangement, as recited in claim 1, wherein said suspension system is capable of being mounted in a predetermined position such that as brake shoe wear occurs, such brake assembly is capable of compensating for brake shoe wear so as to substantially maintain a predetermined distance between each of such brake shoes and such railway vehicle wheels.

18. A suspension system for suspending a truck mounted brake assembly within a railway vehicle truck arrangement, as recited in claim 2, wherein said pivotal attachment of said first end of said suspension link members with such railway vehicle truck arrangement forms a first pivot point and said pivotal attachment of said second end of said suspension link members with such brake heads forms a second pivot point.

19. A suspension system for suspending a truck mounted brake assembly within a railway vehicle truck arrangement, as recited in claim 18, wherein such brake heads are attached to such brake beams via a third pivot point allowing such brake heads to pivot about said second and third pivot points such that such brake heads carrying such brake shoes are capable of matching a radius of such railway vehicle wheel during a brake application.

20. A suspension system for suspending a truck mounted brake assembly within a railway vehicle truck arrangement, as recited in claim 1, wherein such truck bolster member includes a pair of extension members at each end thereof allowing for a pivotal connection of said first means with such truck bolster member.

21. A suspension system for suspending a truck mounted brake assembly within a railway vehicle truck arrangement, as recited in claim 4, wherein such truck bolster member includes an extension member substantially in alignment with each of such strut members allowing for a pivotal connection of said second means with such strut members and with such truck bolster member.

22. A suspension system for suspending a truck mounted brake assembly within a railway vehicle truck arrangement, as recited in claim 11, wherein such truck bolster member includes an extension member substantially in alignment with each of such strut members allowing for a pivotal connection of said second means with such strut members and with such truck bolster member.

23. A suspension system for suspending a truck mounted brake assembly within a railway vehicle truck arrangement, as recited in claim 1 wherein each of such truck side frames include extension members attached thereto allowing for pivotal attachment of at least one of said first and second means with such truck side frames.

24. A suspension system for suspending a truck mounted brake assembly within a railway vehicle truck arrangement, such railway vehicle truck arrangement including a pair of truck side frames, a wheel and axle set at each end of such pair of truck side frames and a truck bolster member, such truck mounted brake assembly including a pair of brake beams, a strut member securable with each of such brake beams and a brake head attachable to each end of each of such brake beams, each of such brake heads carrying a brake shoe thereon, each of such brake heads being positioned for engagement of a respective one of such brake shoes with each of such wheels during a brake application, said suspension system comprising:

(a) a first means pivotally connected at a first end thereof with a predetermined portion of such railway vehicle truck arrangement and pivotally connected at a second end thereof to a predetermined portion of such truck mounted brake assembly for suspending such pair of brake beams in such railway vehicle truck arrangement; and (b) a second means having at least a portion thereof connected with one of each one of, i) such pair of brake beams and, ii) each one of such strut members for maintaining each of such brake beams in a predetermined plane during application and release of such railway vehicle brake assembly.

25. A suspension system for suspending a truck mounted brake assembly within a railway vehicle truck arrangement, as recited in claim 24, wherein said suspension system is capable of being mounted in a predetermined position such that as brake shoe wear occurs, such brake assembly is capable of compensating for brake shoe wear so as to substantially maintain a predetermined distance between each of such brake shoes and such railway vehicle wheels.

26. A suspension system for suspending a truck mounted brake assembly within a railway vehicle truck arrangement, as recited in claim 24, wherein such truck bolster member includes a pair of extension members at each end thereof allowing for a pivotal connection of said first means with such truck bolster member.

27. A suspension system for suspending a truck mounted brake assembly within a railway vehicle truck arrangement, as recited in claim 24, wherein such truck bolster member includes an extension member substantially in alignment with each of such strut members allowing for a pivotal connection of said second means with such strut members and with such truck bolster member.

28. A suspension system for suspending a truck mounted brake assembly within a railway vehicle truck arrangement, as recited in claim 24 wherein each of such truck side frames include extension members attached thereto allowing for pivotal attachment of at least one of said first and second means with such truck side frames.

29. A suspension system for suspending a truck mounted brake assembly within a railway vehicle truck arrangement, such railway vehicle truck arrangement including a pair of truck side frames, a wheel and axle set at each end of such pair of truck side frames and a truck bolster member, such truck mounted brake assembly including a pair of cast brake beams and a brake head attachable to each end of each of such brake beams, each of such brake heads carrying a brake shoe thereon, each of such brake heads being positioned for engagement of a respective one of such brake shoes with each of such wheels during a brake application, said suspension system comprising:

(a) a first means pivotally connected at a first end thereof with a predetermined portion of such railway vehicle truck arrangement and pivotally connected at a second end thereof to a predetermined portion of such truck mounted brake assembly for suspending such pair of brake beams in such railway vehicle truck arrangement; and (b) a second means having at least a portion thereof connected with each one of such pair of brake beams for maintaining each of such brake beams in a predetermined plane during application and release of such railway vehicle brake assembly.

30. A suspension system for suspending a truck mounted brake assembly within a railway vehicle truck arrangement, as recited in claim 29, wherein said suspension system is capable of being mounted in a predetermined position such that as brake shoe wear occurs, such brake assembly is capable of compensating for brake shoe wear so as to substantially maintain a predetermined distance between each of such brake shoes and such railway vehicle wheels.

31. A suspension system for suspending a truck mounted brake assembly within a railway vehicle truck arrangement, as recited in claim 29, wherein such truck bolster member includes a pair of extension members at each end thereof allowing for a pivotal connection of said first means with such truck bolster member.

32. A suspension system for suspending a truck mounted brake assembly within a railway vehicle truck arrangement, as recited in claim 29, wherein each of such truck side frames include extension members attached thereto allowing for pivotal attachment of at least one of said first and second means with such truck side frames.

33. A suspension system for suspending a truck mounted brake assembly within a railway vehicle truck arrangement, as recited in claim 29, wherein each of such cast brake beams includes a brake cylinder mounted thereon.

* * * * *